US008136185B2

(12) United States Patent
Olszewski

(10) Patent No.: US 8,136,185 B2
(45) Date of Patent: Mar. 20, 2012

(54) TRANSPORT CARRIAGE FOR THE PATIENT-BEARING SURFACE OF AN OPERATING TABLE

(75) Inventor: Jan Donat Olszewski, Rastatt (DE)

(73) Assignee: Maquet GmbH & Co. KG, Rastatt (DE)

( * ) Notice: Subject to any disclaimer, the term of this patent is extended or adjusted under 35 U.S.C. 154(b) by 754 days.

(21) Appl. No.: 12/207,825

(22) Filed: Sep. 10, 2008

(65) Prior Publication Data

US 2009/0067963 A1 Mar. 12, 2009

(30) Foreign Application Priority Data

Sep. 12, 2007 (DE) ..... 10 2007 043 431

(51) Int. Cl.
*A47B 7/00* (2006.01)

(52) U.S. Cl. ..... 5/611; 5/625; 414/349

(58) Field of Classification Search ..... 414/349; 5/611, 625, 627
See application file for complete search history.

(56) References Cited

U.S. PATENT DOCUMENTS

| | | | | |
|---|---|---|---|---|
| 5,083,331 | A * | 1/1992 | Schnelle et al. | 5/600 |
| 5,123,797 | A * | 6/1992 | Schnelle et al. | 414/401 |
| 5,528,782 | A * | 6/1996 | Pfeuffer et al. | 5/611 |
| 5,537,700 | A * | 7/1996 | Way et al. | 5/611 |
| 5,651,150 | A * | 7/1997 | Kanitzer et al. | 5/600 |
| 5,659,909 | A * | 8/1997 | Pfeuffer et al. | 5/600 |
| 6,322,251 | B1 * | 11/2001 | Ballhaus et al. | 378/209 |
| 7,225,898 | B2 * | 6/2007 | Bourgeois | 187/200 |
| 7,669,258 | B2 * | 3/2010 | Koch | 5/600 |
| 7,735,788 | B2 * | 6/2010 | Newkirk et al. | 248/129 |
| 8,015,638 | B2 * | 9/2011 | Shimada et al. | 5/611 |
| 2007/0067912 | A1 * | 3/2007 | Lemire | 5/611 |
| 2007/0118989 | A1 * | 5/2007 | Koch | 5/600 |
| 2008/0047068 | A1 * | 2/2008 | Zakrzewski | 5/611 |
| 2008/0086816 | A1 * | 4/2008 | Farooqui | 5/601 |
| 2008/0101905 | A1 * | 5/2008 | Morris et al. | 414/540 |
| 2009/0104007 | A1 * | 4/2009 | Umezawa et al. | 414/349 |
| 2009/0222988 | A1 * | 9/2009 | Reed et al. | 5/627 |

FOREIGN PATENT DOCUMENTS

| | | | |
|---|---|---|---|
| EP | 491165 | A1 * | 6/1992 |
| GB | 2274242 | A | 7/1994 |
| RU | 2168941 | C2 | 6/2001 |
| RU | 2212216 | C1 | 9/2003 |
| WO | 9421209 | A1 | 9/1994 |
| WO | 9742876 | A1 | 11/1997 |

* cited by examiner

*Primary Examiner* — Joshua Rudawitz
(74) *Attorney, Agent, or Firm* — McCormick, Paulding & Huber LLP

(57) ABSTRACT

In a transport carriage for the patient-bearing surface of an operating table, comprising a chassis (10), two supports (58) which are arranged thereon and each have at their upper ends an interface (60) for connecting to a complementary interface on the patient-bearing surface, and a lifting device (48) for adjusting the height of the interfaces (60) relative to the chassis (10), the supports (58) are carried by a pivoting frame (34) which is mounted on the chassis (10) so as to be able to pivot about a horizontal pivot axis (42) and is adjustable by means of the lifting device (48), the supports (58) each being connected to the pivoting frame (34) by a joint (62) having a joint axis (64) parallel to the pivot axis (42) and each being guided on a guide path (70), which is secured to the chassis, in each case set vertically apart from the joint (62) by means of a roller (68) having a roller axis (69) parallel to the pivot axis, in such a way that a line (70), which runs through the joint axis (64) and the roller axis (68) perpendicularly to said supports, remains vertical on the adjustment of the pivoting frame (34).

6 Claims, 3 Drawing Sheets

TRANSPORT CARRIAGE FOR THE PATIENT-BEARING SURFACE OF AN OPERATING TABLE

CROSS REFERENCE TO RELATED APPLICATIONS

Applicant hereby claims foreign priority benefits under U.S.C. §119 from German Patent Application No. 10 2007 043 431.8 filed on Sep. 12, 2007, the contents of which are incorporated by reference herein.

FIELD OF THE INVENTION

The invention relates to a transport carriage for the patient-bearing surface of an operating table, comprising a chassis, two supports which are arranged thereon and each have at their upper ends an interface for connecting to a complementary interface on the patient-bearing surface, and a lifting device for adjusting the height of the interfaces relative to the chassis.

BACKGROUND OF THE INVENTION

In a known embodiment of a transport carriage of this type, the supports are telescopic in their configuration to allow the height of the interfaces to be adjusted by pushing the supports together or pulling them apart. High tilting moments, which occur as a result of markedly eccentric bearing of patients, cause high friction in this type of vertical guidance. Correspondingly powerful drives for vertical adjustment must be provided to overcome this friction.

The invention is based on the object of specifying a transport carriage of the type mentioned hereinbefore in which the vertical adjustment can be carried out with low friction.

SUMMARY OF THE INVENTION

According to the invention, this object is achieved in that the supports are carried by a pivoting frame which is mounted on the chassis so as to be able to pivot about a horizontal pivot axis and is adjustable by means of the lifting device, in that the supports are each connected to the pivoting frame by a joint having a joint axis parallel to the pivot axis and in that the supports are each guided on the chassis, in each case set vertically apart from the joint by means of a roller having a roller axis parallel to the pivot axis, in such a way that a line, which runs through the joint axis and the roller axis perpendicularly to said supports, remains vertical on the adjustment of the pivoting frame.

The parts involved in the vertical adjustment are all mounted in rotary or pivot joints which can be configured with very low friction. This gives rise to low power loss and the lifting drive can be accordingly simple and inexpensive in its configuration, as it does not have to accommodate any lateral guidance forces.

Preferably, the pivoting frame comprises two bars which are articulated to the chassis, each carry a support and are joined together by a cross strut on which the lifting device acts.

The lifting device can comprise a hydraulic lifting unit or be electromechanical in its configuration.

Preferably, the roller is formed by a roller bearing which is connected to the respective support and guided on the chassis. The guide path can for example be formed by a slot in a part which is secured to the frame and in which the roller bearing runs. The course of the guide path is obtained by marking off on the vertical parallel lines, starting from a circle described by the centre of the joint about the pivot axis of the pivoting frame, in each case the stretch corresponding to the distance between the joint axis and the roller axis. The guide path is defined by the line joining together the stretch ends which are remote from the circle.

BRIEF DESCRIPTION OF THE DRAWINGS

The following description describes the invention with reference to an exemplary embodiment and in conjunction with the appended drawings, in which.

DETAILED DESCRIPTION OF THE INVENTION

Figure 1:
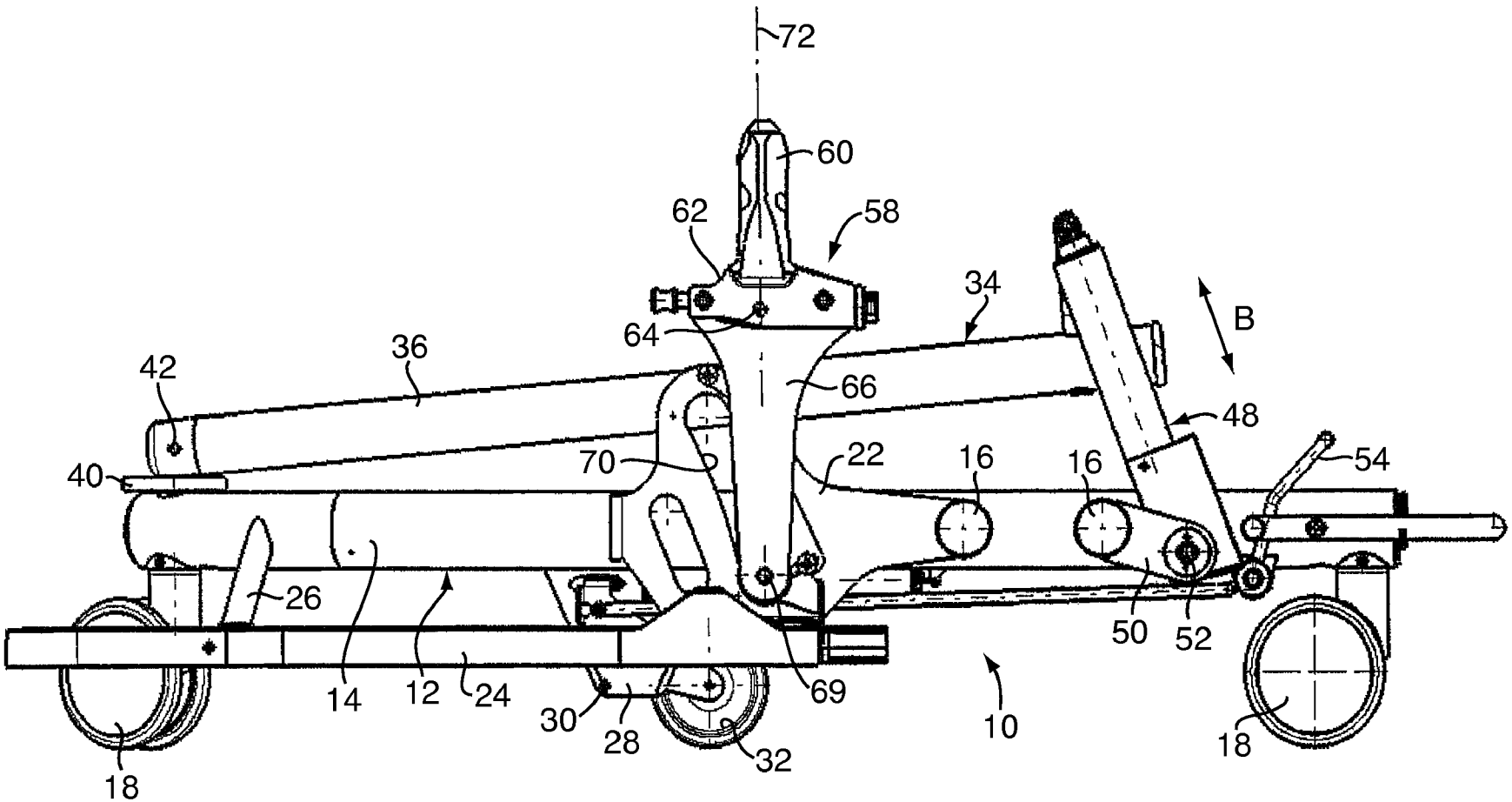
FIG. 1 is a longitudinal section through the transport carriage according to the invention along line I-I in FIG. 3, with the pivoting frame in its lowest position.
Figure 2:
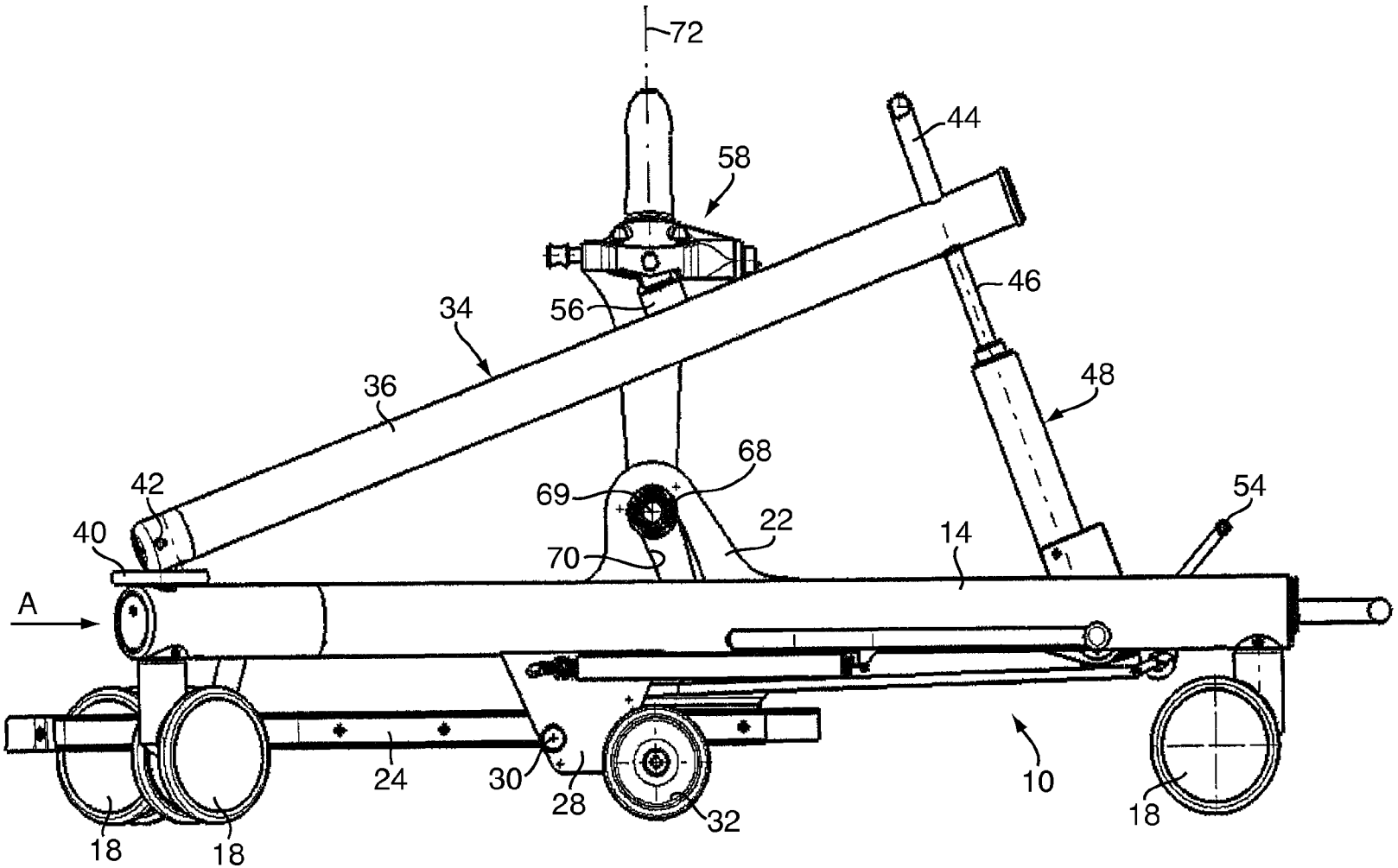
FIG. 2 is a side view of the transport carriage with the pivoting frame in its highest position.
Figure 3:
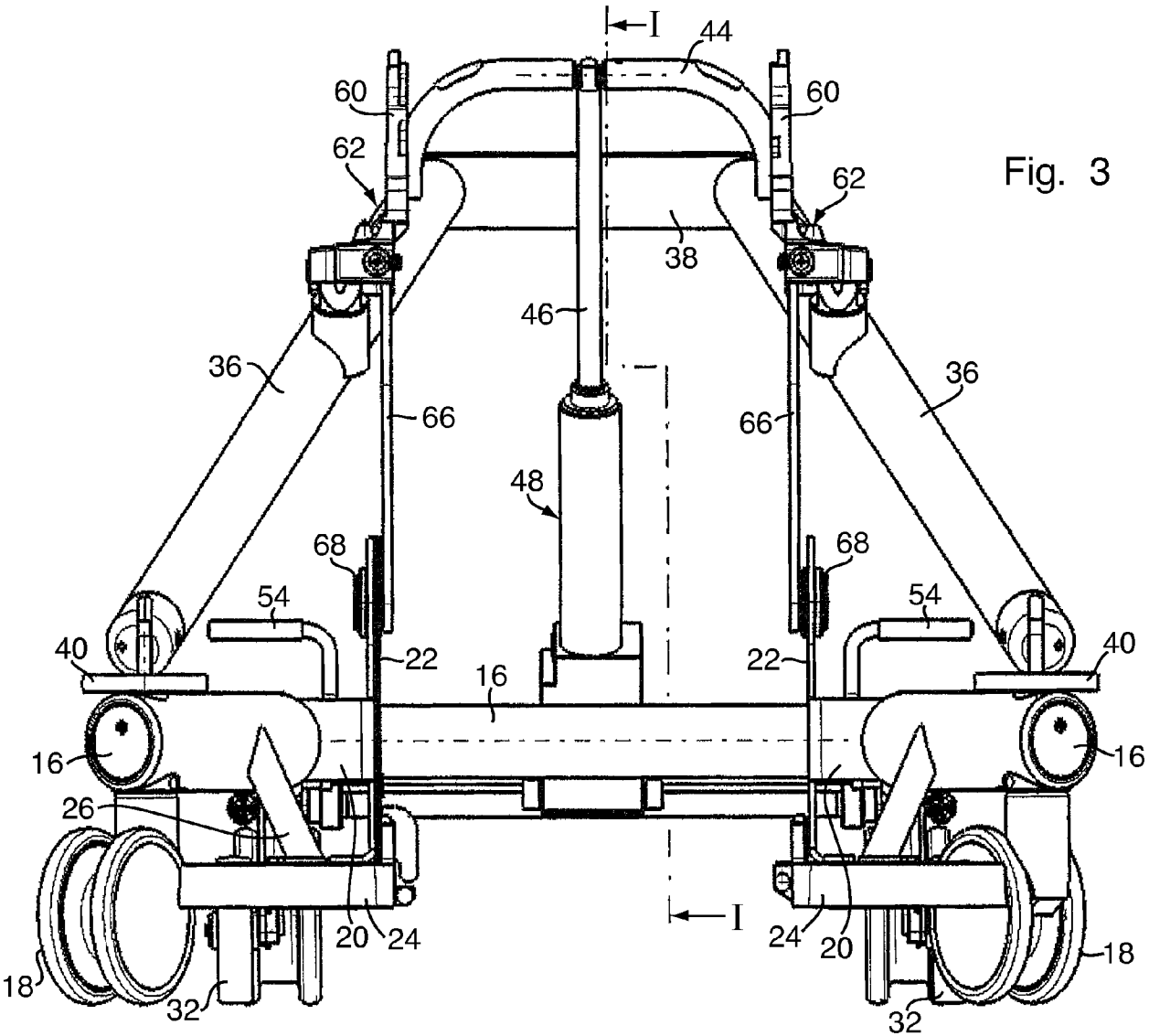
FIG. 3 is a view of the transport carriage from the front, i.e. in the direction of the arrow A in FIG. 2.

The transport carriage illustrated in FIG. 1 to 3 comprises a chassis, denoted generally by reference numeral 10, with a chassis frame 12 consisting of two longitudinal bars 14 joined together by two cross bars 16. Steering rollers 18 are arranged at each of the ends of the longitudinal bars 14. In a central region of the longitudinal bars 14, a vertically directed plate 22 is fastened in each case via an attachment 20 (FIG. 3). A guide rail 24, which is connected to the respective longitudinal bar 14, in proximity to the leading end thereof, via an arm 26 and is outwardly curved toward the leading end of the transport carriage, is fastened to the lower edge of said plate. The guide rails 24 are intended to facilitate the approach of the transport carriage toward a column of the operating table on which the patient-bearing surface lies. Furthermore, a triangular roller carrier 28, on which a support roller 32 is rotatably mounted, is mounted at the lower end of the plate 22 so as to be able to pivot about an axis 30. The support roller 32 can be raised or lowered toward the ground by swivelling the roller carrier 28.

The chassis 10 carries a pivoting frame which is generally denoted by reference numeral 34 and consists of two longitudinal carriers 36 which at one of their ends are joined together via a cross strut 38 (FIG. 3) and at their respective other ends are articulated to a bearing bracket 40, which is carried by the respective longitudinal bar 14, so as to be able to pivot about a pivot axis 42. The two longitudinal carriers 36 are joined together in proximity to the cross strut 38, not only by said cross strut 38, but also by a bow 44, at the longitudinal centre of which acts the piston rod 46 of a hydraulic lifting cylinder 48 which, for its part, is mounted between two arms 50, which are rigidly connected to one of the cross bars 16, so as to be able to pivot about a pivot axis 52. The hydraulic lifting cylinder 48 can be actuated via pedals 54 arranged on both sides of the chassis 10 to adjust the pivoting frame 34 between the lowest position shown in FIG. 1 and the highest position shown in FIG. 2 in the direction of the double-headed arrow B.

Each of the longitudinal carriers 36 carries in a central region a bearing bracket 56 on which a support 58 having an interface 60, which can be coupled to a patient-bearing surface (not shown) of an operating table for coupling to a complementary interface, is mounted in a joint 62 so as to be able to pivot about a joint axis 64. The support 58 further comprises a brace 66 which is connected to the interface 60 and carries at its lower end a roller bearing 68 having a roller axis 69. The roller bearing 68 is guided in a guide path 70 formed by a curved slot in the plate 22. This guidance of the brace 66 ensures that the support 58 at all times maintains the vertical position indicated by the dot-dash line 72 as the pivoting frame 34 swivels about the pivot axis 42. The shape of the guide path 70 may be determined in a simple manner by marking off on parallel lines, starting from a circle which is described by the pivot axis 42 and runs through the joint axis 64, in each case the distance between the joint axis 64 and the roller axis 69. A connecting line through the foot points of the stretches corresponds to the course of the guide path 70.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A transport carriage for a patient-bearing surface of an operating table, comprising:

a chassis;

a lifting device;

a pivoting frame mounted on the chassis so as to be able to pivot about a horizontal pivot axis and so as to be adjustable by means of the lifting device;

two supports, each of the two supports being connected to the pivoting frame by a joint having a joint axis parallel to the pivot axis, each of the two supports having a roller with a roller axis parallel to the pivot axis and spaced apart vertically from the joint axis, and each of the two supports having at its upper end an interface for connecting to a complementary interface on the patient-bearing surface;

wherein the roller on each of the two supports moves along a curved guide path on the chassis in such a way that a line, which runs through the joint axis and the roller axis, remains vertical when the pivoting frame is adjusted.

2. The transport carriage according to claim 1, wherein the pivoting frame comprises two carriers which are articulated to the chassis, each carry a support and are joined together by a bow on which the lifting device acts.

3. The transport carriage according to claim 1, wherein the lifting device comprises at least one hydraulic lifting unit.

4. The transport carriage according to claim 1, wherein the lifting device comprises at least one electromechanical lifting unit.

5. The transport carriage according to claim 1, wherein the roller on each support is formed by a roller bearing.

6. The transport carriage according to claim 1, wherein the guide path is formed by a slot in a part which is secured to the chassis.

* * * * *